US006244324B1

(12) United States Patent
Quates et al.

(10) Patent No.: US 6,244,324 B1
(45) **Date of Patent: *Jun. 12, 2001**

(54) BARRIER

(75) Inventors: Robert B. Quates; David P. Ketcham, both of Charlotte, NC (US)

(73) Assignee: Total Retraction Inc., Charlotte, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/405,990

(22) Filed: Sep. 27, 1999

(51) Int. Cl.[7] ..... E06B 9/08
(52) U.S. Cl. ..... 160/23.1; 160/290.1; 160/311
(58) Field of Search ..... 160/23.1, 190, 160/311, 309, 312, 290.1, DIG. 11, 67

(56) References Cited

U.S. PATENT DOCUMENTS

| | | | | |
|---|---|---|---|---|
| 1,097,949 | * | 5/1914 | Sparks | 160/23.1 |
| 1,119,499 | * | 12/1914 | Donaldson et al. | 160/23.1 |
| 1,217,210 | * | 2/1917 | Packer | 160/23.1 |
| 2,503,773 | * | 4/1950 | Schuster et al. | 160/23.1 |
| 3,465,805 | * | 9/1969 | Lyman | 160/23.1 |
| 4,427,050 | | 1/1984 | Toppen . | |
| 4,523,620 | | 6/1985 | Mortellite . | |
| 5,148,848 | * | 9/1992 | Murray et al. | 160/67 |
| 5,292,169 | * | 3/1994 | O'Brian | 160/67 X |
| 5,370,367 | | 12/1994 | Zaguroli, Jr. . | |
| 5,484,051 | | 1/1996 | Nagai et al. . | |
| 5,860,440 | * | 1/1999 | Murray et al. | 160/67 X |

* cited by examiner

*Primary Examiner*—David M. Purol
(74) *Attorney, Agent, or Firm*—Timothy R. Kroboth

(57) ABSTRACT

A barrier extendable and retractable beneficially in response to a changing environment of use, is disclosed. In use, the barrier is attached at its ends to support surfaces. An extension and retraction mechanism for the barrier beneficially exerts substantially constant force regardless of the barrier extent. In a preferred embodiment, a ball screw, an axially movable ball screw nut, and gas springs are used.

20 Claims, 6 Drawing Sheets

BARRIER

FIELD OF THE INVENTION

This invention relates to an extendable and retractable barrier.

BACKGROUND OF THE INVENTION

Assemblies making use of an axially movable member threadedly mounted on a screw and connected to a spiral spring motor, in lowering and raising a window shade are illustrated by U.S. Pat. No. 4,427,050 to Toppen and U.S. Pat. No. 4,523,620 to Mortellite. As the axially movable member rotates when the shade is lowered, the spring motor is increased in tension. Also known as exemplified by U.S. Pat. No. 5,484,051 to Nagai et al, is the use of an axially movable member threadedly mounted on a rotatable ball screw shaft coupled to a rotatable shaft of an electric motor, with rodless cylinders including pistons movable by fluid pressure, for vertically moving a workpiece. In addition, as illustrated by U.S. Pat. No. 5,370,367 to Zaguroli, Jr., an axially movable ball nut threadedly mounted on a ball screw fixed within a drum reel for a cable, is known to be rotatable by regulated air pressure applied to the drum reel. In an embodiment of the zaguroli device, piston and cylinder shock absorbers pressurized by a source of compressed air, oppose cable wind up.

However, none of this prior art provides a barrier attached, in use, at both ends to support surfaces, and extendable and retractable beneficially in response to a changing environment of use. In such case, extension or retraction of the barrier as needed, could prevent damage to, or tearing or even destruction of, the barrier. Moreover, none of this prior art provides a barrier in combination with an extension and retraction mechanism that exerts substantially constant force regardless of the barrier extent. Furthermore, none of this prior art provides a barrier useful as a visual barrier and extending between coupled passenger rail cars for reducing the possibility that a visually impaired person intending to step into a rail car, might accidentally step off a train platform onto the tracks.

SUMMARY OF THE INVENTION

In accordance with the present invention, there is provided an extendable/retractable barrier including an end attachable to a support surface, and an opposite end fixed to a rotatable cylinder in operative connection with a barrier extension and retraction mechanism. Beneficially, the extension and retraction mechanism exerts a substantially constant opposing force against barrier extension and likewise a substantially constant retractive force, regardless of the barrier extent. Advantageously, this mechanism includes a shaft and an axially movable nut threadedly mounted thereon and connected to gas springs, and axial movement of the nut on the shaft upon extending the barrier, applies force to the gas springs. In a preferred embodiment, a ball screw nut is threadedly mounted on a ball screw, and is connected to gas springs having a substantially flat force curve.

The term "substantially" for purposes of this description, is best understood by consideration of force vs. displacement from which it can be seen that for certain gas springs only a small increase in force results with increased displacement, whereas by comparison a very significant increase in force occurs with increased displacement for a spiral spring as in the Toppen or Mortellite or Zaguroli devices. Thus, the term "substantially" is intended to embrace a small amount of change in force, typically less than about 20 to 30% change, usually about 5 to 10% change, but in any event is intended to distinguish from a change of 50% or more.

Advantageously, the rotatable cylinder is disposed in a housing having an opening through which the barrier is extended and retracted. Beneficially, the opening is formed in part by a wall of the housing having an angled wall portion, and a second rotatable cylinder is disposed within the housing at the entrance to the opening.

In a useful embodiment, the rotatable cylinder for the barrier is disposed in a first housing, and the shaft, axially movable nut and gas springs are disposed in a second housing, and the first housing and the second housing are disposed in a side-by-side relationship, and are fastened to, but easily separable from, one another for interchangeability of housings.

Beneficially, the attachable barrier end includes at least one eyelet to be captured, retained and released by a cooperating mechanism attached to a support structure. A preferred latch and release mechanism includes an elongated mounting plate to be attached to a support structure, and a plurality of spaced apart projections extending from the mounting plate and disposed generally perpendicular to the mounting plate. The projections include aligned apertures, and the mechanism includes a spring-biased retention pin movable between an eyelet retention position, and an eyelet release position in which it is retracted clear of the eyelet.

Additional advantages and beneficial features of the present invention are set forth in the drawing and detailed description, and in part will become apparent to those skilled in the art upon examination of the drawing and detailed description or may be learned by practice of the invention. In the drawing and detailed description, there are shown and essentially described only preferred embodiments of this invention, simply by way of illustration of the best mode contemplated of carrying out this invention. As will be realized, this invention is capable of other and different embodiments, and its several details are capable of modification in various respects, all without departing from the invention. Accordingly, the drawing and the detailed description are to be regarded as illustrative in nature, and not as restrictive.

BRIEF DESCRIPTION OF THE DRAWING

Reference is now made to the accompanying drawing, which forms a part of the specification of the present invention

DETAILED DESCRIPTION OF THE INVENTION

Figure 1:
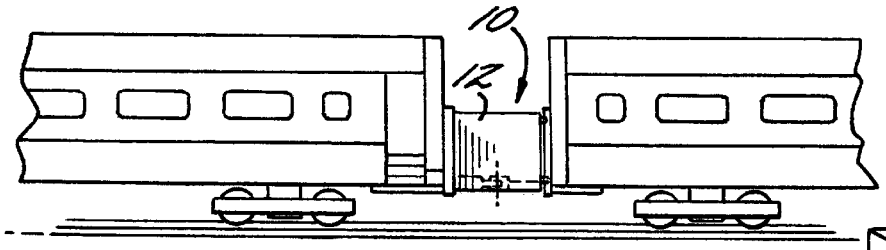
FIG. 1 depicts a preferred apparatus in accordance with the present invention, in which a barrier is attached to, and extended between, coupled passenger rail cars.

In accordance with the present invention, a barrier attached, in use, at both ends to support surfaces, and extendable and retractable beneficially in response to a changing environment of use, is provided. Thus, when the barrier needs to extend further, the invention allows for further extension of the barrier, and when a decreased extent is appropriate, the invention provides for suitable retraction of the barrier so that the barrier may be advantageously maintained tight across its extent. In a particularly useful application, such a barrier may be attached at both its ends to, and extend for instance as a visual barrier between, coupled passenger rail cars. Tautness of the barrier in such an application beneficially reduces the effect of, for instance, wind from tearing or otherwise damaging, or from destroying, the barrier.

In use with rail cars and for other applications, it is important for the barrier to be further extendable or partially retractable as appropriate, and beneficially for the change in extent to occur automatically. For instance, because the distance between coupled rail cars is subject to change as the cars proceed from linear track to curved track and vice versa, change in the extent of a barrier extending between and attached to adjacent rails cars, is needed. Also, if a person fell into a barrier attached at its ends to support surfaces, or an object or person otherwise forcefully contacted the barrier, it would be beneficial if the barrier extended to withstand the force.

Because the present invention is especially beneficial for use with passenger rails cars, the description and drawings have been primarily drawn thereto. However, as can be readily understood, other applications exist, and the material of which a barrier will be made will be selected depending upon factors including the durability and toughness desired, and cost. Terms such as "upwardly", "downwardly", "lower" and the like used in this description are relative, and have been particularly used with reference to the drawing to assist understanding.

Figure 2:
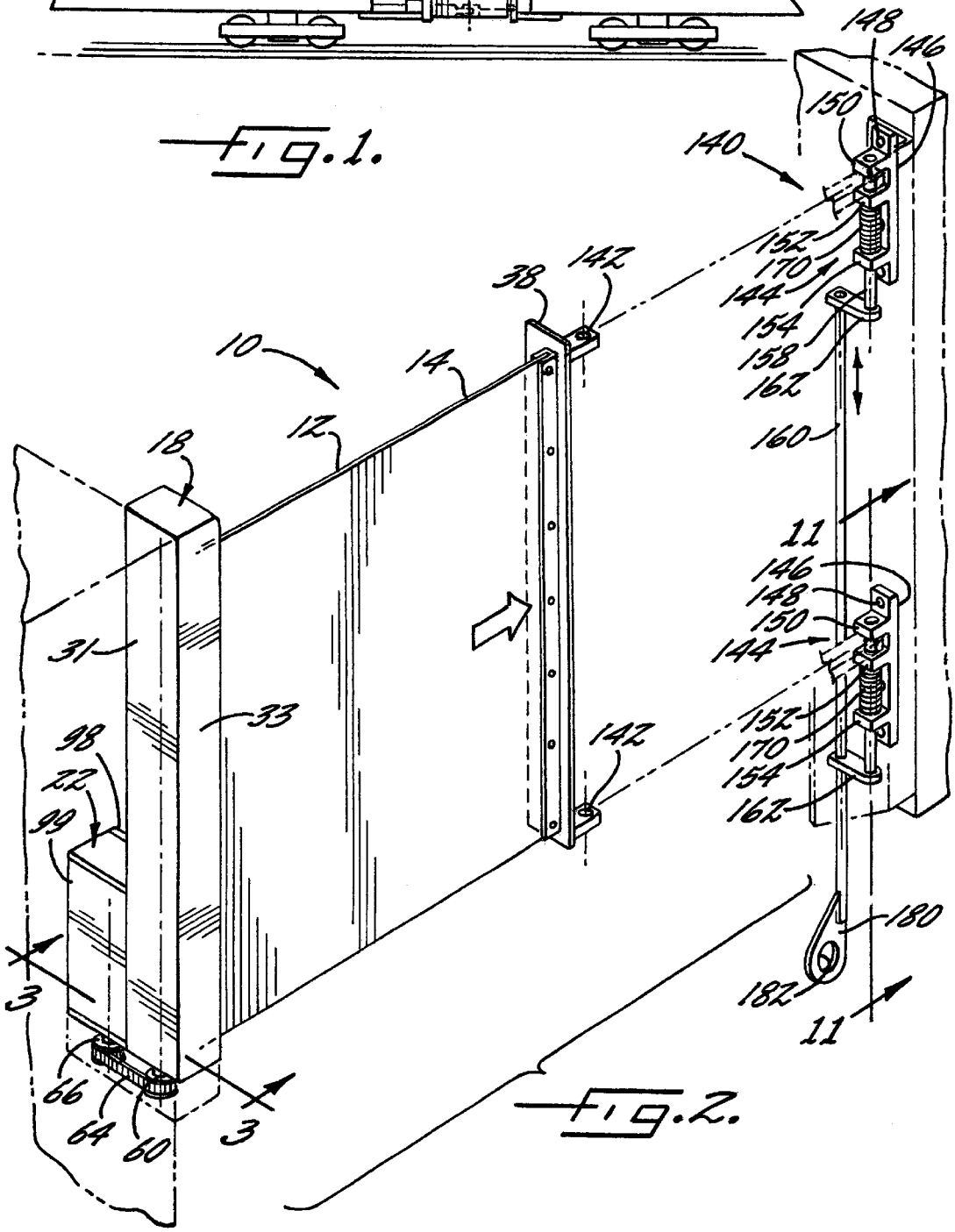
FIG. 2 is a perspective view showing further details of the apparatus of FIG. 1 including a preferred latch and release mechanism, and in phantom line, spaced apart, support structures to which the apparatus is mounted.

With reference to FIGS. 1 and 2, a preferred apparatus 10 in accordance with the present invention, includes a barrier 12 extendable and retractable beneficially in response to changing distance between, for example, adjacent coupled passenger rail cars. In such an application, referring in particular to FIG. 2, a first end of the barrier may be conveniently attached to an end of one rail car near or at a corner indicated in phantom line, and an opposite end 14 of the barrier may be conveniently attached to the near end of the adjacent rail car close to or at a corner likewise indicated in phantom line, so that the barrier is attached to, and extends between, the rail cars. As described in later detail, barrier end 14 is advantageously releasingly attachable.

Referring now to FIGS. 3 to 7 for further details, the first end (not shown) of barrier 12 is beneficially fixed to a generally cylindrical shaft 16 rotatable about its own axis within a housing 18 and connected to a preferred mechanism 20 for automatic extension and retraction of the barrier as appropriate. Advantageously in accordance with the present invention, in the operation of mechanism 20, extension of the barrier is opposed by a substantially constant force, and likewise the force effecting barrier retraction is substantially constant, regardless of the barrier extent.

Figure 8:
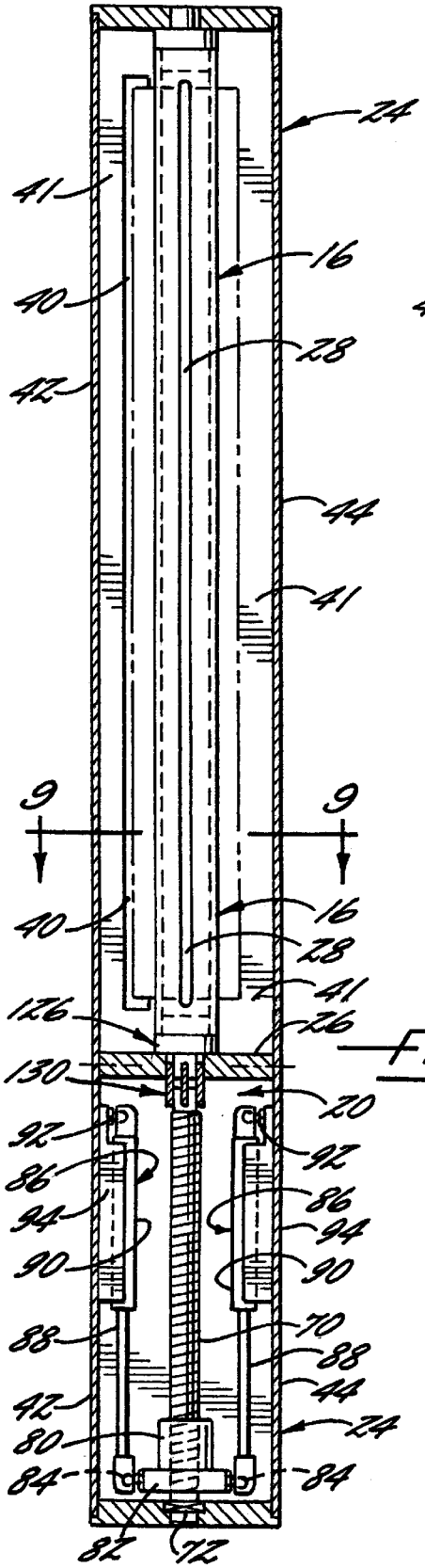
FIG. 8 is a sectional view similar to FIG. 3 of an arrangement of a second preferred embodiment in accordance with the present invention.

An extension/retraction mechanism in accordance with the present invention, may be in a separate housing 22 disposed generally side by side to housing 18, or with reference to the embodiment of FIG. 8, may be generally axially aligned with shaft 16 and in a single housing 24 with a divider wall 26, or may be otherwise connected to or aligned with respect to shaft 16 or a like wind-up cylinder provided that there is operative connection with the mechanism. In any event, shaft 16 or a like wind-up cylinder is attached, as indicated in FIG. 2, to a support surface.

As indicated in FIG. 3, and again referring to the embodiment of FIG. 8, the first end of the barrier may be fixed by insertion into an elongated slit 28 in shaft 16. Suitable attachment making use of fasteners or attachment to a peripheral cylindrical wall or otherwise, may alternatively be used. Referring particularly to FIG. 4 and also to FIG. 9, when not extended, barrier 12 is conveniently wrapped around shaft 16 and stored within a housing. To this end, the barrier is sufficiently pliable to be wound around shaft 16. Thus, the barrier may be conveniently stored, as well as protected against, for example, weather.

Figure 6:
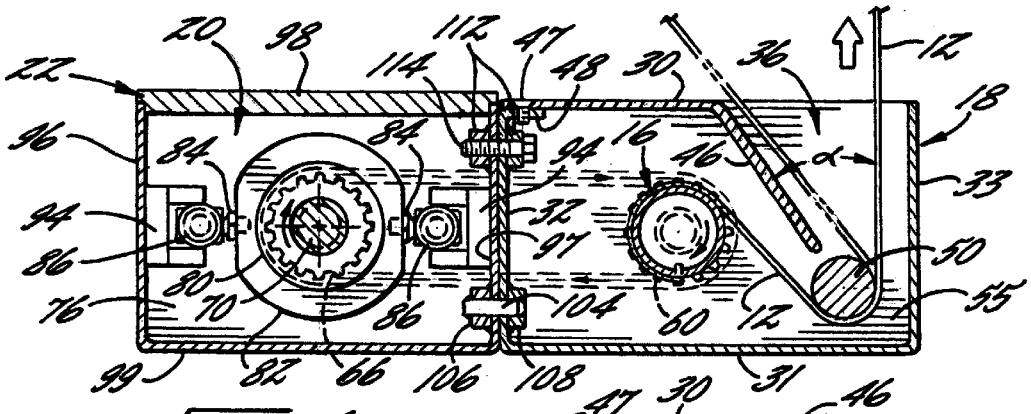
FIGS. 6 and 7 are similar views to FIGS. 4 and 5, respectively, but show the barrier in an extended position.
Figure 9:
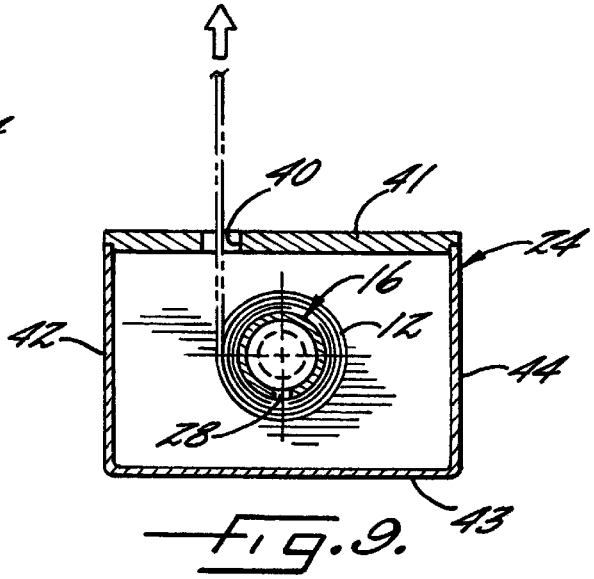
FIG. 9 is an enlarged sectional view taken substantially along line 9—9 of FIG. 8.

With continued reference to FIG. 4 and also referring particularly to FIG. 6, housing 18 for barrier 12 is formed in part by opposing walls 30, 31 and opposing walls 32, 33, and includes an opening 36 between walls 30, 33 through which the barrier is extended and retracted, and opening 36 may beneficially be a widened opening in combination with a suitably dimensioned cover 38 attached to barrier end 14. Cover 38 beneficially closes the opening when the barrier is not extended. The term "widened opening"0 is intended, for purposes of this description, to distinguish over a slot-like opening 40 as shown in FIG. 9, located in a wall 41 of housing 24 formed in part by walls 41, 42, 43 and 44, and to embrace an opening providing for a greater side to side range of barrier movement (indicated by phantom line in FIG. 6) without contact with a housing wall forming the opening. Thus, a widened opening is especially advantageous when the barrier is used between coupled rail cars. Otherwise, deleterious wall/barrier contact interfering with extension or retraction of, or resulting in premature wear to or in tearing of, the barrier may result from movement of the rail cars relative to one another and consequent side to side movement of the barrier.

If desired, housing wall 30 forming widened opening 36 may include an angled wall portion 46 by which an opening is provided which advantageously increases in width in the direction of the exiting barrier as illustrated in FIG. 6. By the term "angled"0 is meant, for purposes of this description, that the wall portion is at an acute angle a relative to, rather than parallel to, an exit alignment of the barrier as depicted in solid line in FIG. 6. In any event, wall 30 is advantageously removably attached by fasteners 47 to a partially underlying, support wall 48. As a result, access to the housing interior is conveniently provided.

Advantageously, angled wall portion 46 may be used with a second generally cylindrical shaft 50 rotatable about its own axis, mounted within housing 18, and generally positioned as illustrated in, for instance, FIG. 6 at the entrance of the exiting barrier to widened opening 36; and barrier 12 is passed from shaft 16 around shaft 50 prior to its exit from the housing. Rotatable shaft 50 beneficially guides the barrier through the opening, reduces friction on the moving barrier, facilitates any side to side movement of the barrier, and assists in maintaining the barrier under tension when the barrier moves side to side as it passes through the opening during extension or retraction. As can be understood with reference to FIG. 6, the barrier could be made to exit in an opposite direction from housing 18 by replacing opposite wall 31 with wall 30 including its angled portion 46, replacing wall 30 including its angled portion 46 with wall 31, and by changing the location of shaft 50 so that it is positioned at the entrance to the newly located exit opening.

As will readily be understood, the height of barrier 12, the lengths of rotatable shafts 16, 50, and the length of opening 36 generally conveniently correspond to one another, and, along with other features such as the width of the opening and the length of the barrier, can vary and will typically be selected depending upon the particular application.

Figure 3:
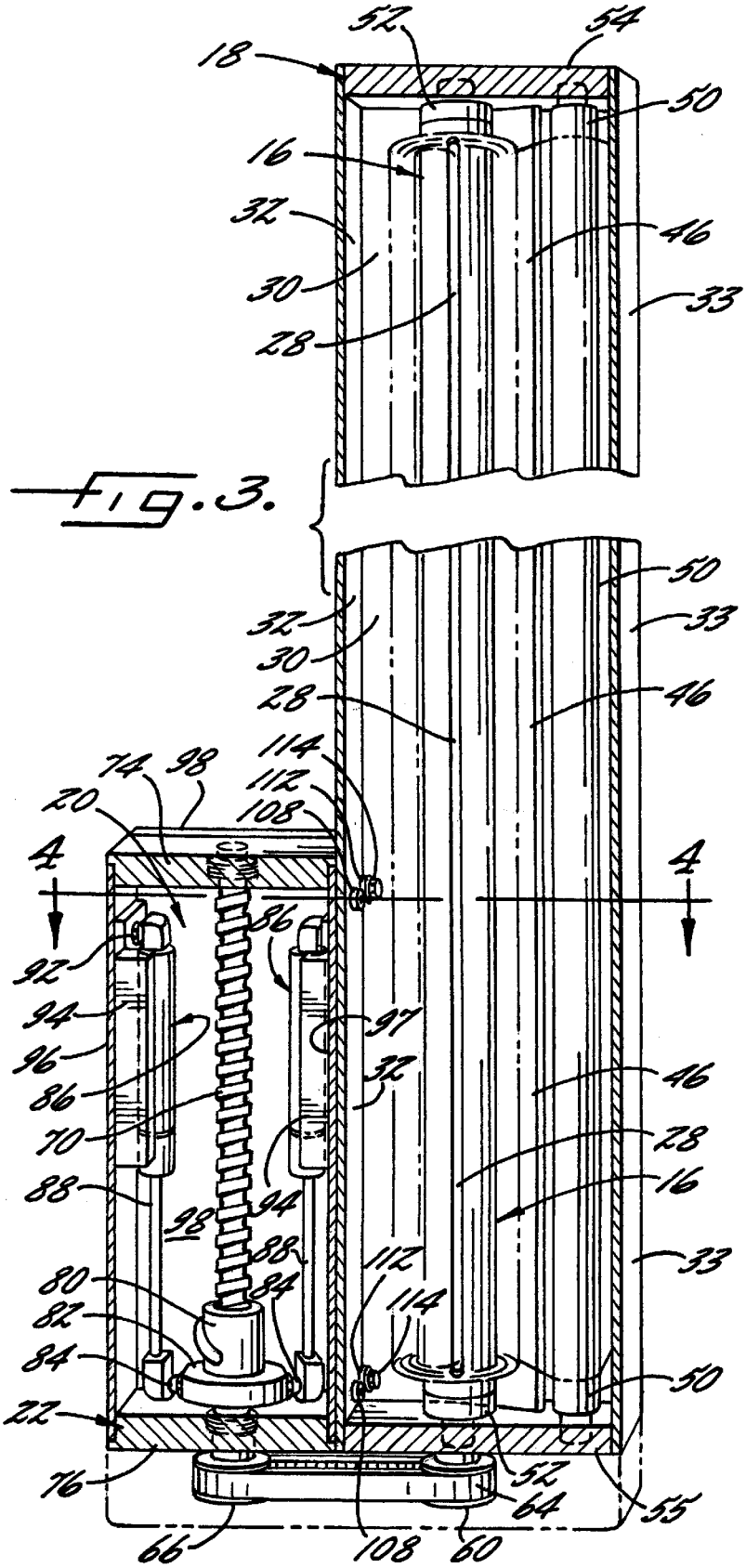
FIG. 3 is an enlarged, sectional view taken substantially along line 3—3 of FIG. 2, with the barrier in phantom line for clarity of other details.
Figure 4:
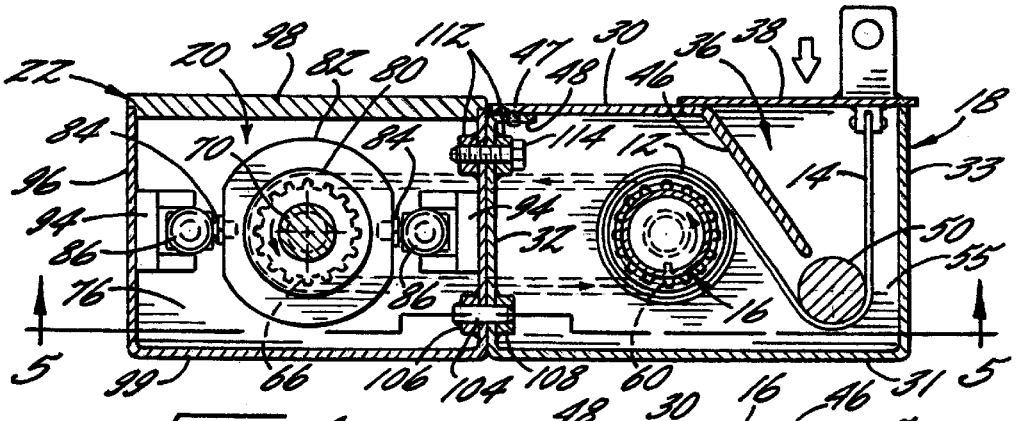
FIG. 4 is a further enlarged, sectional view taken substantially along line 4—4 of FIG. 3, showing the barrier fully retracted.
Figure 5:
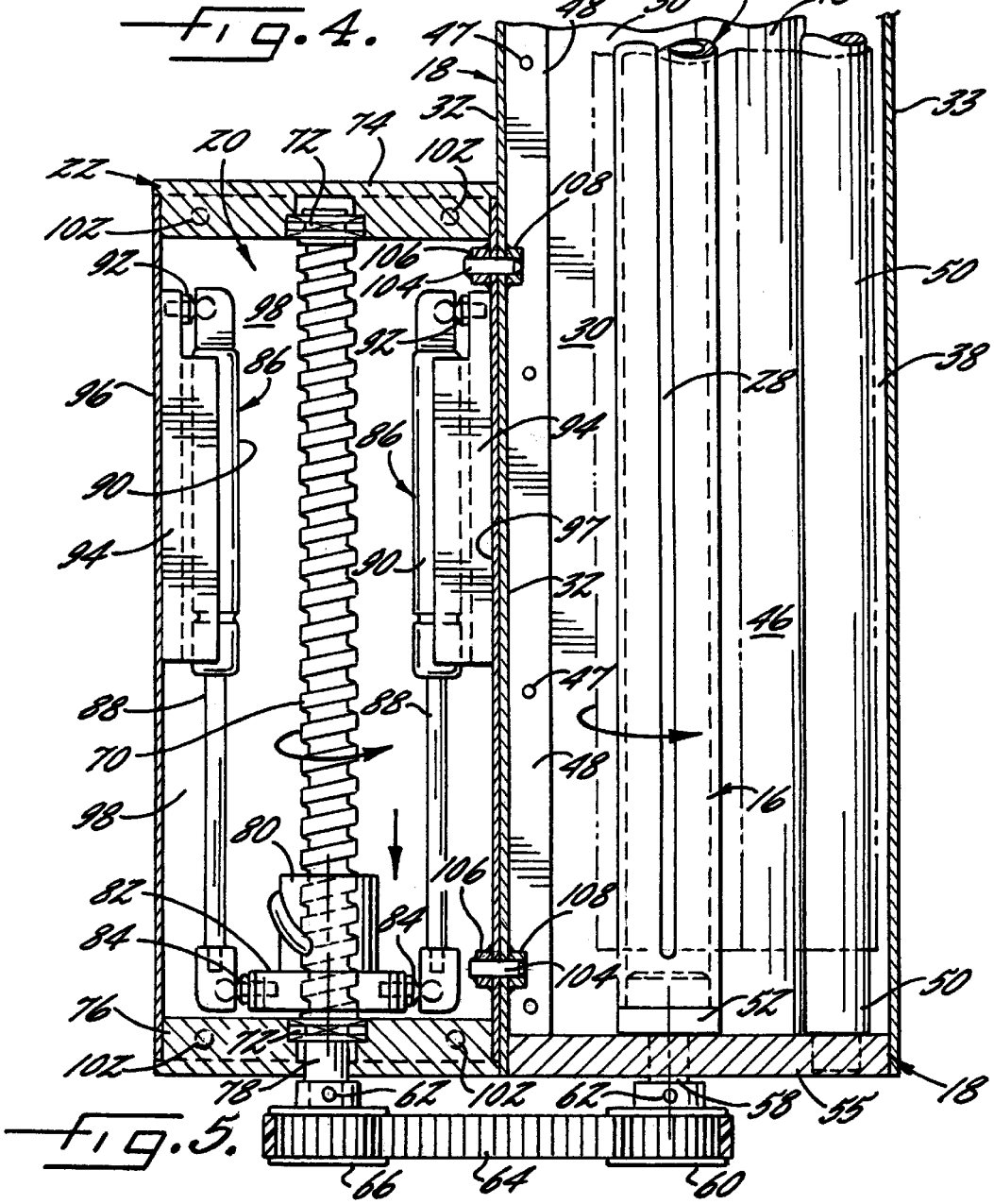
FIG. 5 is a sectional view taken substantially along line 5—5 of FIG. 4, with the barrier again in phantom line for clarity of other details.
Figure 7:
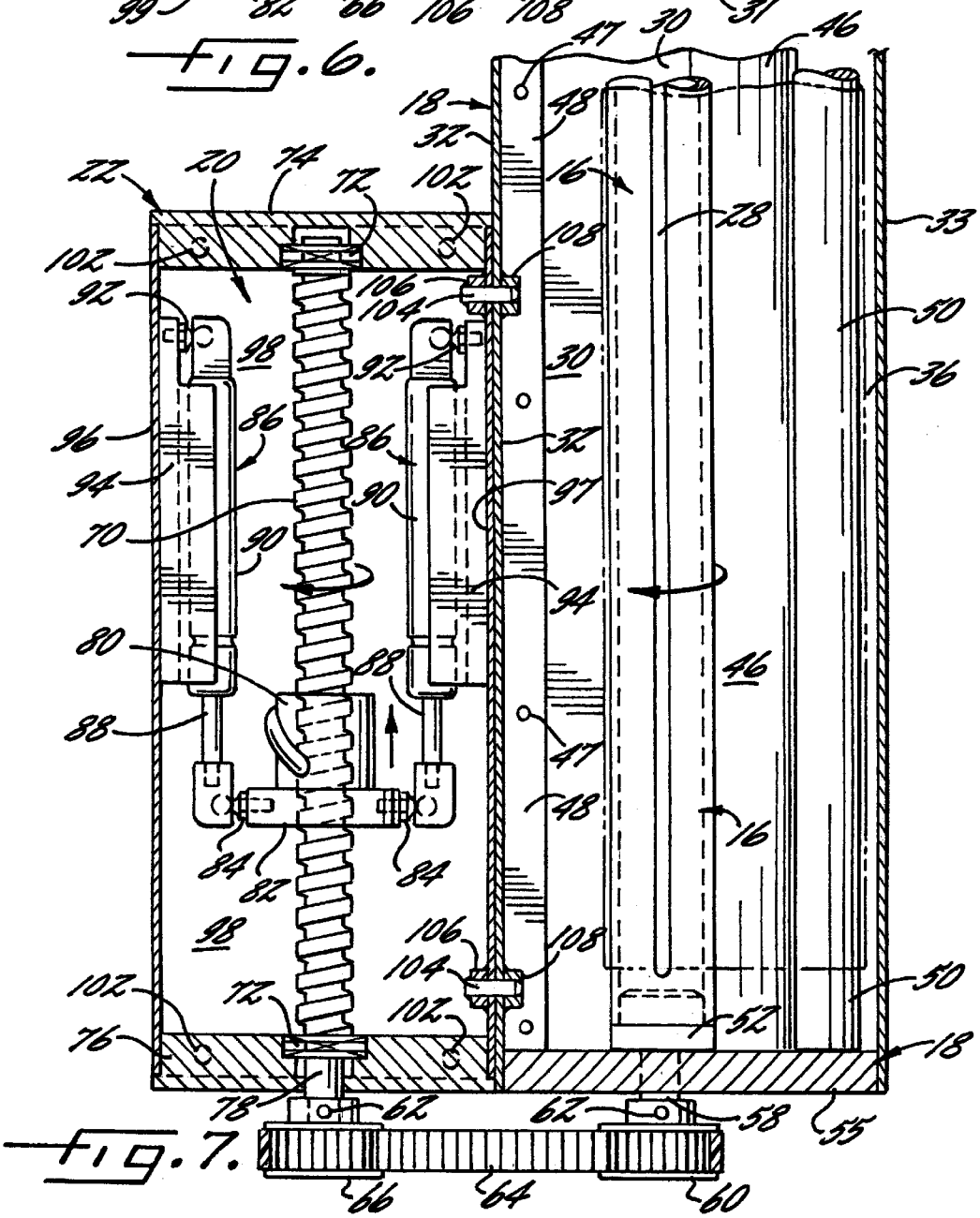
Figure 10:
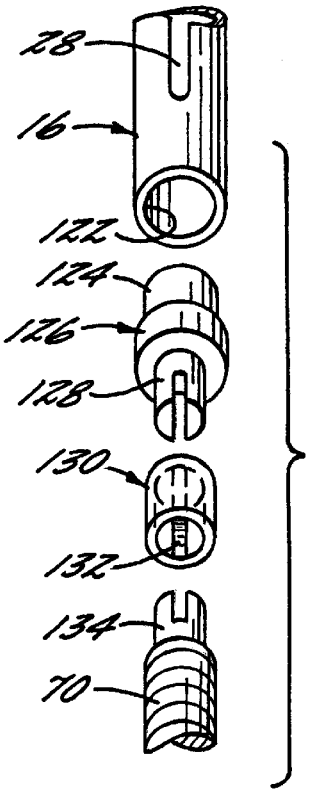
FIG. 10 shows details of the coupling used in the embodiment of FIG. 8.

Referring particularly to FIG. 3, the opposite ends of shaft 16 (conveniently by means of adaptors 52 like coupling member 126 of FIG. 10), and the opposite ends of shaft 50 are rotatably mounted in opposing end walls 54, 55 of housing 18. With reference particularly also to FIGS. 5 and 7, shaft end 58 projects through end wall 55, and a cog wheel 60 mounted on the projecting shaft end is secured by a set screw 62. A ribbed belt 64 connects wheel 60 with a second cog wheel 66 secured by a set screw 62 to preferred barrier extension/retraction mechanism 20. If desired, meshing gear wheels, rather than a ribbed belt, or other suitable operative connection could be used between shaft 16 or a like wind-up cylinder, and mechanism 20. In any event, a cover shown in phantom line, conveniently encloses wheels 60, 66 and belt 64.

With continued reference to FIGS. 5 and 7 in particular, disposed within housing 22 is a ball screw 70 conveniently rotatable about its axis, and having opposite ends conveniently mounted in thrust bearings 72 disposed in recesses in opposing housing end walls 74,76. Screw end 78 projects through its thrust bearing and end wall 76, and wheel 66 is mounted on and secured to the projecting shaft end as previously described. An axially movable ball screw nut 80 is threadedly mounted on the ball screw, and a flange 82 is conveniently mounted on an end of the ball screw nut and connects the ball screw nut by means of connectors 84 beneficially to a pair of gas springs 86 disposed in axial alignment with the ball screw axis and anchored opposite to one another within housing 22. Specifically, each connection is to a rod 88 attached to a piston (not shown) slidable within a respective gas spring cylinder 90, and each gas spring cylinder is beneficially disposed within an axially elongated recess of, and attached by a connector 92 (conveniently like connector 84) to, an elongated block 94 in axial alignment with the ball screw axis and conveniently secured to opposing housing walls 96,97. In this manner, the axis of each gas spring is maintained in parallel alignment with the ball screw axis, and rotation of the ball screw nut and the gas springs may be conveniently prevented, whereas the ball screw is allowed to rotate.

Although it may be possible to obtain a functional substantially constant force mechanism otherwise, a ball screw and axially movable ball screw nut threadedly mounted thereon have considerable advantage. Furthermore, gas springs beneficially avoid a need for a separate source of compressed air, can provide a substantially flat force curve for the substantially constant force mechanism, and can be relied upon for total retraction of the barrier and advantageous repeatability and return speed. Beneficially, in addition, preferred mechanism 20 provides smooth, yet firm, controlled action.

Referring to FIGS. 4 and 5 in particular, when the barrier is fully retracted, ball screw nut 80 is conveniently positioned on the ball screw distant from gas spring cylinders 90. Barrier retraction is driven by the force exerted by the gas springs upon nut 80 which moves axially on rotating ball screw 70 away from the gas spring cylinders. Directional arrows indicate the direction of axial movement of nut 80, and the consequent direction of rotation of ball screw 70 and cog wheel 66, ribbed belt 64, and cog wheel 60 and shaft 16 to achieve barrier retraction.

With reference to FIGS. 6 and 7 in particular, when the barrier is extended, ball screw nut 80 and in particular flange 82, are conveniently positioned on the ball screw near gas spring cylinders 90. Barrier extension is driven by a force exerted upon the barrier and which is greater than the opposing force of the gas springs. Directional arrows indicate the direction of rotation of shaft 16 and cog wheel 60, ribbed belt 64, cog wheel 66 and ball screw 70, and the consequent direction of axial movement of nut 80 toward the gas spring cylinders, as the barrier is extended. The axial movement of nut 80 applies energy to the gas springs.

As can be understood, energy may be applied to the gas springs as the barrier is extended, in other ways than that shown in the drawing. Thus, for instance, the pitch of the ball screw threads could be reversed, the ball screw nut positioned on the ball screw near housing wall 74 when the barrier is fully retracted, and gas springs 86 and blocks 94 appropriately repositioned. In such case, the ball screw nut would move toward, instead of away from, housing wall 76, but force would be applied to the gas springs and the barrier extended.

With continued reference to FIGS. 4 to 7, housing walls 98, 99 are disposed opposite to one another, and wall 98 is conveniently secured by fasteners 102 to end walls 74, 76 for easy removability for access to the interior of housing 22. Referring again also particularly to FIG. 3, housing 22 including extension/retraction mechanism 20, and housing 18 including shaft 16 are beneficially fastened to, but easily separable from, one another. The easy separability permits ready interchangeability of housings with, for example, ball screws of different length, with housings with barriers of, for instance, different length or height or material. conveniently, fastening together of housings 18, 22 may use alignment pins 104 each seated in a bushing 106 fastened (for example, by welding) to an inside surface of wall 97, projecting through aligned apertures in walls 97, 32, and covered by covers 108, in combination with a plurality of bushings 112 disposed on the inside surfaces of and fastened (for example, welded) to walls 97, 32, around apertures appropriately located in the walls so that threaded bores of bushings 112 are in alignment, and fasteners 114 threaded into aligned bushings. As can be readily understood, the previously described removability of wall 30 from housing 18 benefits access to fasteners 114 and separation of housing 22 and housing 18.

Referring now to FIGS. 8 to 10, a second preferred embodiment is shown which differs from the structure of FIGS. 2 to 7 primarily in having a slot-like opening 40 for extension/retraction of the barrier, in having ball screw 70 in generally axial alignment with shaft 16, and in lacking a second rotatable shaft for the barrier to be passed around. Previously, certain of these and other aspects have been described, and therefore for brevity, like parts have been designated with like numbers with reference to FIGS. 2 to 7, and no further description is given except as follows. Referring particularly to FIG. 10 for details of a convenient connection between shaft 16 and ball screw 70 whereby rotation of the one produces rotation of the other, an open end 122 of shaft 16 is slid onto, in friction fit, an end 124 of a coupling member 126 having an opposite notched end 128 onto which an end of a mating sleeve 130 including an axially extending, mid-line plate 132 is slid, and the opposite end of sleeve 130 is slid onto a mating notched end 134 of the ball screw. Conveniently, a set screw (not shown) may be used to fix shaft 16 to coupling member 126.

Barriers useful in the present invention may be made of a variety of materials but should be sufficiently pliable to allow being wound up, with the material to be used being typically selected dependent upon the intended purpose of the barrier. When used with train cars, the material will beneficially have an appropriate flammability rating, and be tough, durable and weather-resistant as exposure to high train speeds and adverse weather conditions including wind and water can be expected, and because the barrier will be under tension as the motion of the rail cars causes the barrier to be extended further or reduced in extent.

As explained at the outset, in use, barrier end 14 is attached to a support structure. For this purpose, end 14 is beneficially attachable and a variety of suitable attachment mechanisms can be used, including clips. Referring again to FIG. 2 and with reference also to FIGS. 11 and 12, an advantageous latch and release mechanism 140 for use with coupled rail cars, is shown. The use of a substantially constant force extension/retraction mechanism benefits the ease of extension of the barrier for attachment of end 14 to latch and release mechanism 140, as well as safety of personnel and the useful life of the barrier when the barrier is being attached or released from mechanism 140.

Attachability of barrier end 14 is conveniently provided by spaced apart eyelets 142 fixed to cover 38. As can be understood, a single eyelet with an elongated opening may provide sufficient attachment; however, typically, two or more spaced apart eyelets will be used. Cooperating with the eyelets is mechanism 140, which conveniently will include a plurality of latch and release subcomponents 144 consistent with the number of eyelets.

Figure 11:
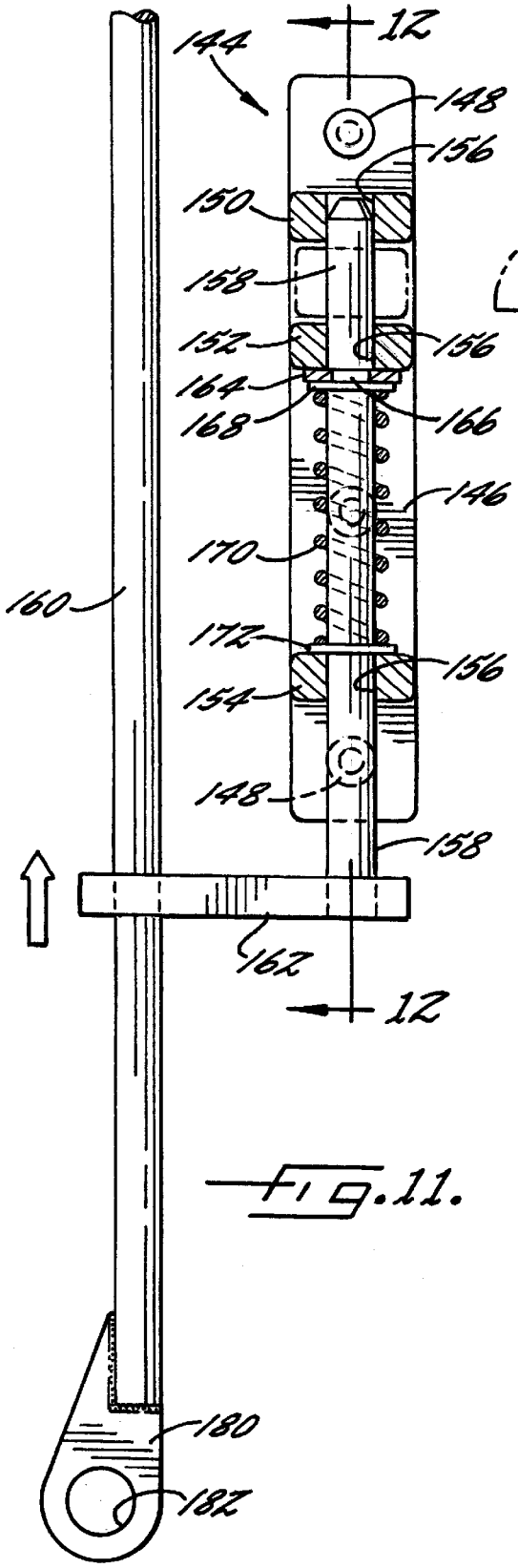
FIG. 11 is an enlarged perspective view of a subcomponent of the preferred latch and release mechanism, taken substantially along line 11—11 of FIG. 2, showing a retention pin in its normal, upwardly extended position for retention of the barrier.
Figure 12:
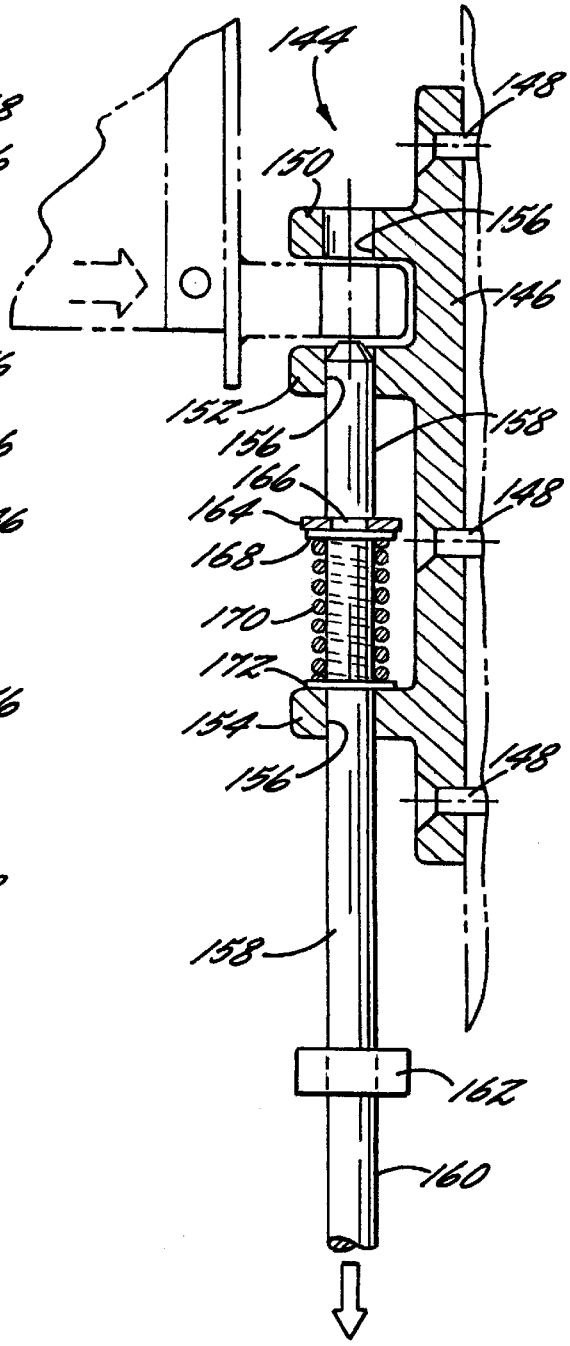
FIG. 12 is a sectional view taken substantially along line 12—12 of FIG. 11, showing the retention pin in a downwardly retracted position for insertion of a barrier eyelet shown in phantom line, prior to return of the retention pin to the latch position of FIG. 11.

With particular reference therefore to FIGS. 11 and 12 for details, subcomponent 144 includes an elongated mounting or backing plate 146 to be fastened to a support structure using a plurality of fasteners 148, and further includes extending from the backing plate and disposed generally perpendicular to the backing plate, a plurality of spaced apart projections 150, 152, 154 including aligned apertures 156 for a retention pin 158 fixed to a release rod 160 by an arm 162 extending from the release rod. Surrounding the retention pin and disposed between projections 152, 154 in sequential order are a snap ring 164 disposed in a circumferential groove 166 in the retention pin, a washer 168 which backs the snap ring, a compression spring 170 for which washer 168 serves as a backing plate, and a second washer 172. Projection 154 supports washer 172, which serves as the opposite backing member for spring 170. As shown in FIG. 11, the snap ring and washer 168 also serve to limit the upward travel of the retention pin.

Referring to FIG. 12 in particular, to attach barrier end 14, the retention pin is pulled downwardly as indicated by the directional arrow, to allow the respective eyelet (shown in phantom) to be inserted between projections 150, 152, and thereby compressing spring 170, and the eyelet is then inserted between projections 150, 152. Thereafter, referring to FIG. 11 in particular, the retention pin is allowed to return to its normal position by which it conveniently extends into the aperture of projection 150, under the upward force exerted by the compression spring as indicated by the directional arrow, and the eyelet is thereby captured and retained. Similarly, to release barrier end 14, release rod 160 is pulled downwardly to pull retention pin 158 downwardly to a retracted position by which the retention pin is substantially clear of the eyelet so that the eyelet is released by the retention pin. As can be understood and with reference to FIG. 2 again, release rod 160 and subcomponents 144 work together to capture and release eyelets 142.

By providing a lower end 180 of the release rod with a suitable shape and an aperture 182, the release rod can be easily pulled. If desired, the lower end of the release rod can be modified to benefit remote automated release.

Various modifications may be made and some have been described. Thus, the present invention may be carried out with various modifications without departing from the spirit or essential attributes thereof. Accordingly, reference should be made to the appended claims as indicating the scope of the invention.

What is claimed is:

1. An extendable/retractable barrier comprising an end attachable to a support surface, and an opposite end fixed to a rotatable cylinder, wherein said rotatable cylinder is in operative connection with a mechanism exerting regardless of the barrier extent, a substantially constant opposing force against barrier extension and likewise a substantially constant retractive force, said mechanism comprising a shaft and an axially movable nut threadedly mounted thereon and connected to gas springs, wherein axial movement of said nut on said shaft upon extending said barrier, applies energy to said gas springs.

2. The barrier of claim 1, wherein said rotatable cylinder is disposed in a housing having an opening through which said barrier is extended and retracted.

3. The barrier of claim 2, wherein said opening is formed in part by a wall of said housing having an angled wall portion.

4. The barrier of claim 3, wherein a second rotatable cylinder for guiding said barrier through said opening, is disposed within said housing at the entrance to said opening.

5. The barrier of claim 1, wherein said shaft is rotatable about its axis, and said gas springs are disposed in axial alignment with the shaft axis.

6. The barrier of claim 1, wherein said shaft and said nut are a ball screw and a ball screw nut.

7. The barrier of claim 1, wherein elongated blocks comprising axially elongated recesses disposed in contact with said gas springs, restrain rotation of said nut.

8. The barrier of claim 1, wherein said rotatable cylinder for said barrier is disposed in a first housing, and said shaft, said nut and said gas springs are disposed in a second housing, and said first housing and said second housing are disposed in a side-by-side relationship, and are fastened together and easily separable from one another.

9. The barrier of claim 1, wherein said attachable barrier end comprises at least one eyelet to be captured and retained by a cooperating mechanism attached to a support structure.

10. The barrier of claim 9, wherein the capture and retention mechanism comprises a mounting plate, a plurality of spaced apart projections extending from said mounting plate and disposed generally perpendicular to said mounting plate, said projections including aligned apertures, and a spring-biased retention pin extending in an eyelet capture position between two of said projections and being retracted in an eyelet release position clear of said eyelet.

11. An extendable/retractable barrier comprising an end attachable to a support surface, and an opposite end fixed to a rotatable cylinder, wherein said rotatable cylinder is in operative connection with a mechanism comprising a shaft and an axially movable nut in threaded engagement with said shaft and connected to a gas spring, wherein axial movement of said nut upon extending said barrier, applies energy to said gas spring.

12. The barrier of claim 11, wherein said rotatable cylinder is disposed in a housing having an opening through which said barrier is extended and retracted.

13. The barrier of claim 12, wherein said opening is formed in part by a wall of said housing having an angled wall portion, and a second rotatable cylinder for guiding said barrier through said opening, is disposed within said housing at the entrance to said opening.

14. The barrier of claim 11, wherein said shaft is rotatable about its axis, and said gas spring is axially aligned with the shaft axis.

15. The barrier of claim 11, wherein said nut is threadedly mounted on said shaft, and said shaft and said nut are a ball screw and a ball screw nut.

16. The barrier of claim 11, wherein said mechanism further comprises a second gas spring, and wherein elongated blocks comprising axially elongated recesses disposed in contact with the gas springs, restrain rotation of said nut.

17. The barrier of claim 11, wherein said rotatable cylinder is disposed in a first housing, and said shaft, said nut and said gas spring are disposed in a second housing, and said first housing and said second housing are disposed in a side-by-side relationship.

18. The barrier of claim 11, wherein said gas spring has a substantially flat force curve.

19. The barrier of claim 11, wherein said attachable barrier end comprises at least one eyelet to be captured and retained by a cooperating mechanism attached to a support structure.

20. The barrier of claim 19, wherein the capture and retention mechanism comprises a mounting plate, a plurality of spaced apart projections extending from said mounting plate and disposed generally perpendicular to said mounting plate, said projections including aligned apertures, and a spring-biased retention pin extending in an eyelet capture position between two of said projections and being retracted in an eyelet release position clear of said eyelet.

* * * * *